US006997252B2

(12) United States Patent
Porter et al.

(10) Patent No.: US 6,997,252 B2
(45) Date of Patent: Feb. 14, 2006

(54) HYDRAULIC SETTING TOOL FOR PACKERS

(75) Inventors: Jesse C. Porter, Duncan, OK (US); Brian K. Wilkinson, Duncan, OK (US); Donald R. Smith, Wilson, OK (US); Donald F. Hushbeck, Tulsa, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 274 days.

(21) Appl. No.: 10/661,171

(22) Filed: Sep. 11, 2003

(65) Prior Publication Data

US 2005/0056417 A1 Mar. 17, 2005

(51) Int. Cl.
*E21B 23/01* (2006.01)

(52) U.S. Cl. ..... 166/120; 166/125; 166/126; 166/237

(58) Field of Classification Search ..... 166/125, 166/126, 181, 182, 237, 120, 63
See application file for complete search history.

(56) References Cited

U.S. PATENT DOCUMENTS

| | | | | |
|---|---|---|---|---|
| 2,244,861 A | * | 6/1941 | Walker | 108/44 |
| 3,054,450 A | * | 9/1962 | Baker, Jr. et al. | 166/120 |
| 3,130,788 A | * | 4/1964 | Cochran et al. | 166/217 |
| 4,253,521 A | | 3/1981 | Savage | 166/123 |
| 4,436,149 A | | 3/1984 | Edwards | 166/120 |
| 4,441,552 A | | 4/1984 | Hamman | 166/133 |
| 4,773,478 A | | 9/1988 | Streich | 166/120 |
| 4,823,881 A | | 4/1989 | Streich | 166/382 |
| 4,934,460 A | | 6/1990 | Coronado | 166/386 |
| 5,404,956 A | | 4/1995 | Bohlen et al. | 166/387 |
| 6,142,226 A | | 11/2000 | Vick | 166/120 |

OTHER PUBLICATIONS

Foreign communication from a related counterpart application dated Oct. 8, 2004.
Halliburton Service Tools catalog, pp. 2-34 to 2-39, Sep. 2002.

* cited by examiner

*Primary Examiner*—Hoang Dang
(74) *Attorney, Agent, or Firm*—John W. Wustenberg; Baker Botts L.L.P.

(57) ABSTRACT

A hydraulic setting tool for packers capable of mechanically setting the packer and opening a valve in the packer in one trip. The tool comprises an outer sleeve and an inner mandrel coaxially disposed within the outer sleeve and adapted to move axially relative to the outer sleeve. The tool further comprises three locking mechnisms that unlock under different fluid pressure loads. Two of the locking mechanisms lock the inner mandrel to the outer sleeve in a run-in position. Once a sufficient fluid pressure has been reached to unlock both of these locking mechanisms, the inner mandrel moves upward relative to the outer sleeve to set the packer. A spring forces the inner mandrel into a third position relative to the outer sleeve, which is maintained by the third locking mechanism. This third position is used to open the packer valve.

22 Claims, 8 Drawing Sheets

HYDRAULIC SETTING TOOL FOR PACKERS

BACKGROUND

The present invention relates generally to setting tools for packers and more particularly to a hydraulic setting tool for packers, which is capable of setting the packer and opening the packer valve in one trip.

Generally, the production efficiency of an operating oil and/or gas well decreases over time. This is due to a number of factors. In some cases, it is simply due to the fact that a reservoir containing hydrocarbons is near depletion. In many other cases, it is due to the fact that a path along which the hydrocarbons flow becomes blocked. This can occur for a number of reasons, such as production screens becoming plugged and the closing of a fracture through which the hydrocarbons flow. When this occurs, the well needs to undergo what is known in the art as a "workover." A workover is an operation to open the path along which hydrocarbons flow.

During a workover, production tubing is removed from the well and workover tools are sent downhole in its place. One of the workover tools is a packer. A packer is a device placed in the region of the well that needs treatment. The packer isolates the region needing treatment from the rest of the well. Furthermore, the packer has a valve that can be opened and closed to control the flow of treatment fluid into the subterranean formation. When the workover is complete, the packer is drilled out of the well and the production tubing is inserted back into the well thereby enabling production to resume.

In order to install packers into the well and control the opening and closing of their valves, specialized equipment known as "setting tools" have been developed. Generally, there are two basic types of setting tools, those characterized as mechanical and those characterized as hydraulic. Both types of setting tools are attached at the end of a workstring and are operable from the surface.

Conventional mechanically operated setting tools require that the workstring be rotated in order to set the packer. This raises a number of problems in horizontal wells. For one, rotation of the workstring in a horizontal well can cause the workstring to break. Furthermore, rotation of the workstring at the surface may cause a delayed rotation downhole or no rotation at all. In either case, the well operator cannot be certain that the packer has been set. Drag spring mechanical setting tools have recently had the additional problem of not setting the packer when used in synthetic fluids. These drag spring mechanical setting tools do not offer enough resistance to rotate properly in the new synthetic fluids and thereby fail to set the packers.

Conventional hydraulic setting tools typically employ the use of a ball or plug to create the necessary fluid pressure to activate the packer. A drawback of this technique is that the ball or plug has to be removed from the workstring after the packer is set before performing additional operations. This requires recirculation of the fluid to the surface, which in turn takes time and adds expense to the operation.

A further drawback of conventional mechanical and hydraulic setting tools is that it typically requires at least two trips downhole with the workstring to accomplish the tasks of setting the packer, opening the packer valve and pumping the treatment fluid into the subterranean formation through the packer. The necessity of two trips to accomplish these tasks takes time and thus adds expense to the operation.

Furthermore, conventional setting tools are limited in that multiple setting tools are typically required to set different size packers. This is particularly problematic in offshore applications where space is limited and transporting and storing multiple setting tools on site can be a challenge.

SUMMARY

The present invention provides a hydraulic setting tool for packers, which meets the needs described above and overcome the deficiencies of the prior art. In its preferred embodiment, the hydraulic setting tool in accordance with the present invention has the ability to both set the packer and open the valve in the packer in one trip. It accomplishes this through the use of an outer sleeve and an inner mandrel coaxially disposed within the outer sleeve and adapted to move axially relative to the outer sleeve.

In another aspect of the present invention, the setting tool includes first means for locking the inner mandrel into a first predetermined axial position relative to the outer sleeve. This is the position in which the setting tool is "run-in" the well. Preferably, the first locking means comprises a locking ring housing disposed between the inner mandrel and the outer sleeve and is adapted to be axially movable relative to the inner mandrel and outer sleeve. The first locking means also comprises a piston pin housing attached to a housing connection, which connects the piston pin housing to the inner mandrel. It further preferably comprises a shear pin adapted to fail under a predetermined load, which temporarily secures the locking ring housing to the piston pin housing. The first locking means additionally comprises four locking lugs that are disposed between a flanged end of the locking ring housing and the inner mandrel, which locks the inner mandrel to the outer sleeve so as to make it axially immovable.

In another aspect of the present invention, the first locking means further comprises a shear coupling disposed between the inner mandrel and the outer sleeve wherein the shear coupling has a shoulder against which a flanged-shaped portion of the inner mandrel abuts. It further comprises a shear pin adapted to fail under a predetermined load, which temporarily secures the shear coupling to the outer sleeve thereby making the inner mandrel axially immovable relative to the outer sleeve in an upward direction. The predetermined load necessary to cause the shear pin that temporarily secures the shear coupling to the outer sleeve to fail is preferably greater than the predetermined load necessary to cause the shear pin that temporarily secures the locking ring housing to the piston pin housing to fail. The first locking means thus prevents the setting tool from prematurely setting the packer during run-in.

The first locking means is disengaged by pumping fluid into the setting tool until both shear pins fail. Additional fluid pressure is subsequently added to force the inner mandrel upward relative to the outer sleeve, which in turn sets the packer.

In yet another aspect of the present invention, the hydraulic setting tool further comprises means for biasing the inner mandrel into a second predetermined axial position relative to the outer sleeve. In this position, the setting tool is able to open the valve in the packer. Preferably, the biasing means comprises a helical spring, which at one end engages a shoulder formed in the inner mandrel and at another end engages a shoulder formed in the outer sleeve.

In still another aspect of the present invention, the hydraulic setting tool includes second means for locking the inner mandrel into the second predetermined axial position. The second locking means preferably comprises a locking key disposed in a groove in the outer sleeve and a spring, which forces the locking key into a groove formed in the inner mandrel when the inner mandrel is in the second predetermined axial position thereby locking the inner mandrel to the outer sleeve so as to make it axially immovable.

Other and further objects, features and advantages of the present invention will be readily apparent to those skilled in the art upon a reading of the description of preferred embodiments which follows.

BRIEF DESCRIPTION OF THE DRAWINGS

The present invention is better understood by reading the following description of non-limitative embodiments with reference to the attached drawings wherein like parts of each of the several figures are identified by the same referenced characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Figure 1:
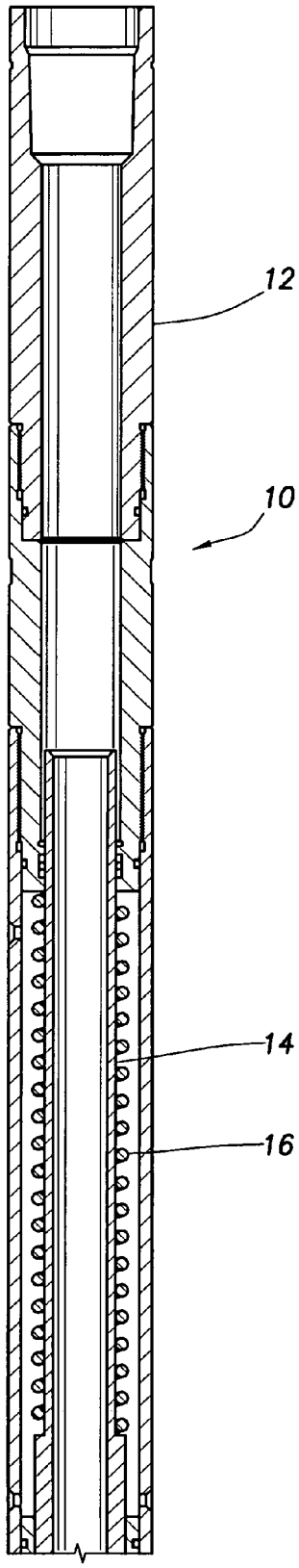
FIGS. 1–3 are schematic diagrams of non-continuous portions of the upper, middle and lower sections of the hydraulic setting tool in accordance with the present invention shown in a "run-in" position.
Figure 2:
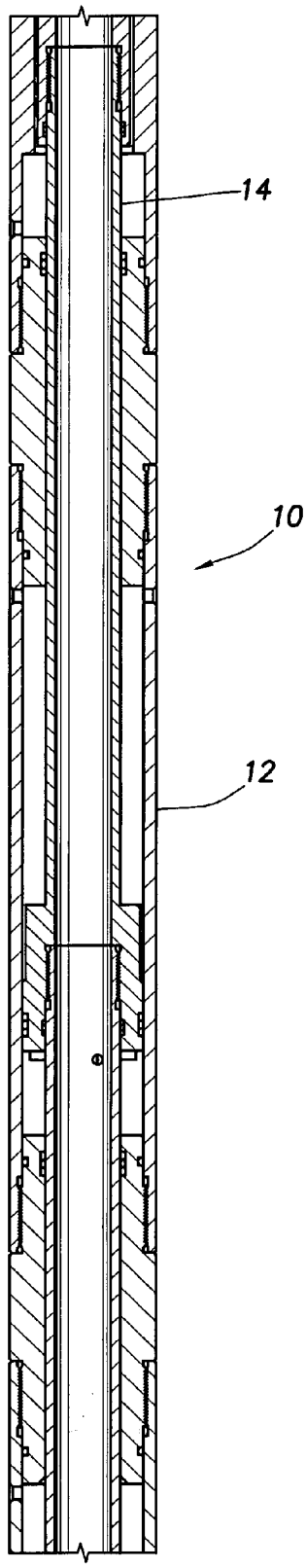
Figure 3:
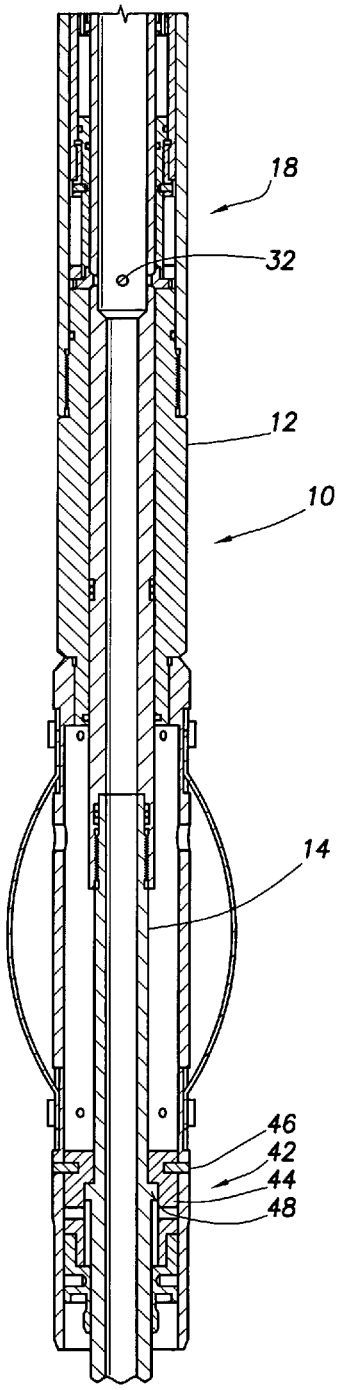

The details of the present invention will now be discussed with reference to the figures. Turning to FIGS. 1–3, a setting tool in accordance with the present invention is shown generally by reference numeral 10. Setting tool 10 comprises an outer sleeve 12 and an inner mandrel 14. The outer sleeve 12 is formed generally of a tubular shaped steel pipe and connects at one end to a workstring (not shown). The inner mandrel 14 is also generally tubular shaped and formed of steel. The inner mandrel 14 is coaxially disposed within the outer sleeve 12 and is adapted to move in the axial direction relative to the outer sleeve 12. A drillable packer 68 is attached to the end of the inner mandrel 14. Although details of the setting tool 10 are discussed with reference to drillable packer 68, it will be understood that setting tool 10 can be used with a retrievable packer, drillable and retrievable bridge plugs, and similar downhole tools.

Setting tool 10 further comprises a spring 16 which abuts at one end against a shoulder of the outer sleeve 12 and abuts at the other end against a shoulder against the inner mandrel 14, as shown in FIG. 1. In compression, the spring 16 supplies an axial force against the inner mandrel 14 tending to move the inner mandrel 14 downward relative to the outer sleeve 12. Spring 16 is preferably formed of steel and assumes the shape of a helical coil. Those of ordinary skill in the art will appreciate other equivalent biasing means may be employed to move the inner mandrel 14 relative to the outer sleeve 12.

Figure 10:
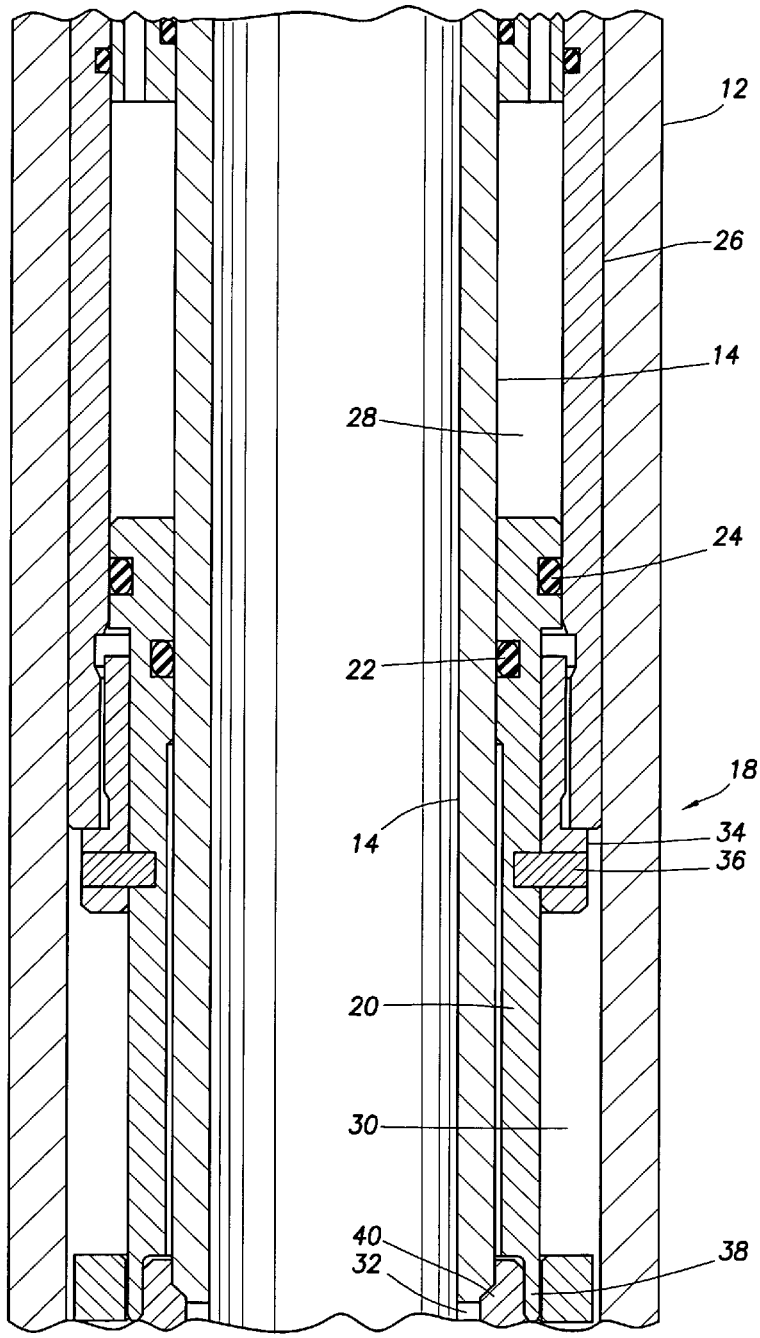
FIG. 10 is an enlarged schematic diagram of that section of the hydraulic setting tool in accordance with the present invention showing the locking mechanism that locks the hydraulic setting tool in both axial directions.

Setting tool 10 further comprises a bi-directional locking device referred to generally by reference numeral 18. The bi-directional locking device 18 comprises a locking ring housing 20, which is generally tubular shaped and coaxially disposed between an outer surface of the inner mandrel 14 and an inner surface of the outer sleeve 12, as best seen in FIG. 10. Locking ring housing 20 is adapted to move axially relative to the outer sleeve 12 and the inner mandrel 14. The locking ring housing 20 comprises an inner O-ring 22 and an outer O-ring 24. Inner and outer O-rings 22 and 24 are preferably formed of an elastomeric material. The inner O-ring 22 seals the locking ring housing 20 against the outer surface of the inner mandrel 14 and the outer O-ring 24 seals the locking ring housing 20 against a housing connection 26, which is disposed within outer sleeve 12. The locking ring housing 20 divides the space between the inner mandrel 14 and the outer sleeve 12 into two chambers, an upper chamber 28 and a lower chamber 30. Fluid is allowed to enter lower chamber 30 through ports 32 formed in the inner mandrel 14, as shown in FIGS. 3 and 10. The inner and outer O-rings 22 and 24 provide a hermetic seal thereby preventing fluid from entering the upper chamber 28 through the lower chamber 30.

Bi-directional locking device 18 further comprises a piston pin housing 34 disposed between the locking ring housing 20 and the housing connection 26. Piston pin housing 34 is attached on one side to housing connection 26 and on the other side to locking ring housing 20. The piston pin housing 34 comprises an annular recess into which a shear pin 36 is placed. The shear pin 36 temporarily attaches the piston pin housing 34 to the locking ring housing 20. Shear pin 36 is designed to fail at a predetermined load, which corresponds to an upward fluid pressure applied to the locking ring housing 20 created by pumping fluid down hole into the lower chamber 30 through ports 32. In one example according to the present invention, the shear pin 36 shears under a pressure of 850 psi.

The locking ring housing 20 further comprises flange 38 at a down hole end, which is designed to abut against a plurality of locking lugs 40. Preferably, there are four locking lugs 40 disposed around the circumference of the inner mandrel 14. More preferably, the locking lugs 40 are spaced equidistant around the circumference of the inner mandrel 14, i.e., they are disposed 90° apart from one another. Locking lugs 40 are designed to abut against the flange 38 of the locking ring housing 20, and a shoulder formed in the outer sleeve 12, and reside in a groove in the inner mandrel 14. Locking rings 40 act as a wedge and prevent bi-directional axial movement of the inner mandrel 14 relative to the outer sleeve 12.

Setting tool 10 comprises another locking device 42, which prevents inner mandrel 14 from moving relative to the outer sleeve 12 in a "run-in" position. The locking device 42 includes a shear coupling 44, which is attached to the outer sleeve 12 by shear pin 46, as shown in FIG. 3. The shear coupling 44 is coaxially disposed between the inner mandrel 14 and the outer sleeve 12. It has an annular recess formed within it for threading engagement with the shear pin 46. The shear pin 46 is designed to fail at a predetermined load, which is preferably higher than the predetermined load necessary to cause shear pin 36 to fail. In one embodiment, the shear pin 46 fails at approximately 1,200 psi. The shear coupling 44 also includes a shoulder, which is designed to abut against a flange 48 formed on an outer surface of the inner mandrel 14. Shear coupling 44 prevents upward movement of the inner mandrel 14 relative to the outer sleeve 12, and bi-directional movement of the packer 68 relative to the outer sleeve 12. More specifically, it prevents the inner mandrel 14 from moving axially relative to the outer sleeve 12 in the event that the setting tool 10 is inadvertently thrust against an obstruction during run-in. It thereby prevents premature setting of the packer 68.

Figure 5:
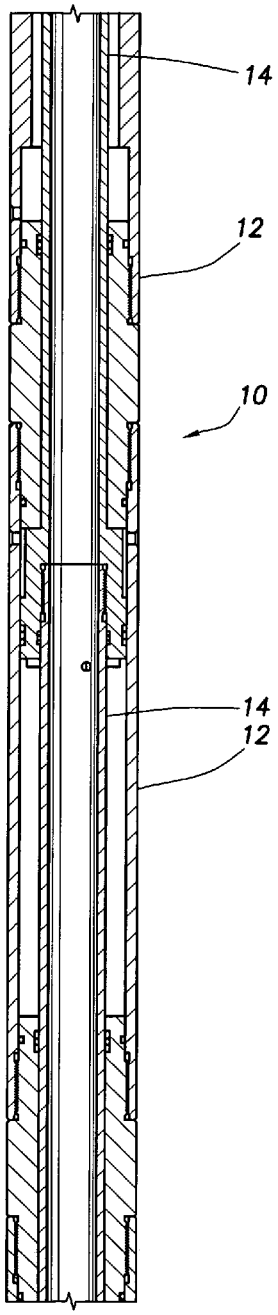
Figure 7:
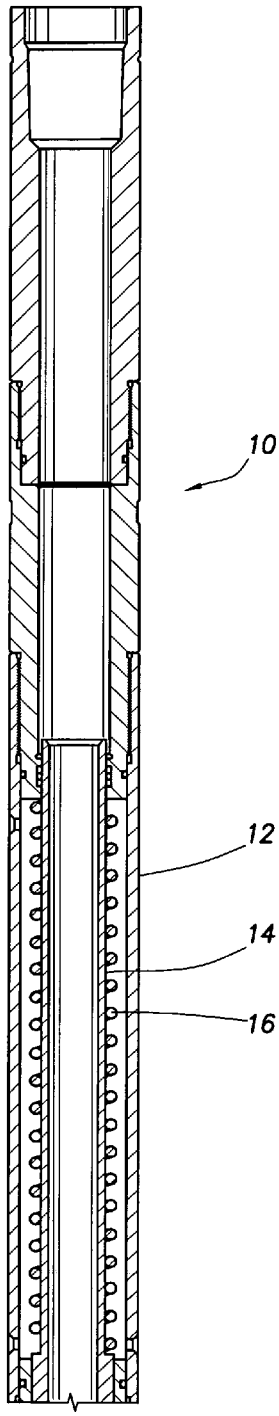
FIGS. 7–9 are schematic diagrams of non-continuous portions of the upper, middle and lower sections of the hydraulic setting tool in accordance with the present invention shown in a "stinger-locked" position.
Figure 8:
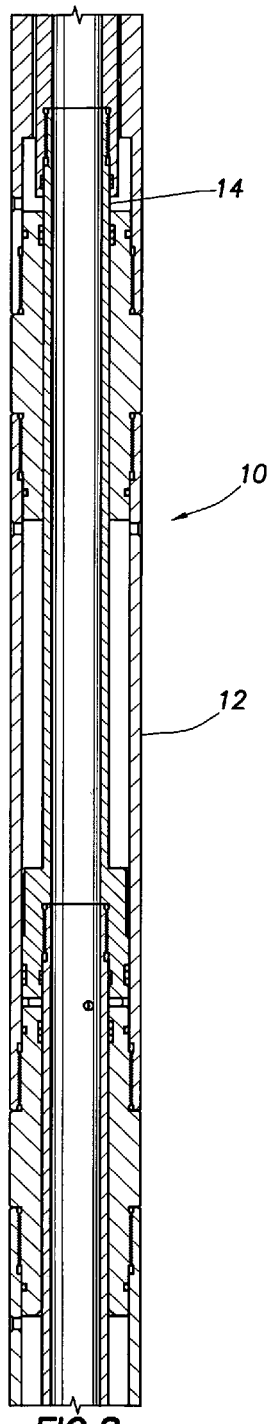
Figure 9:
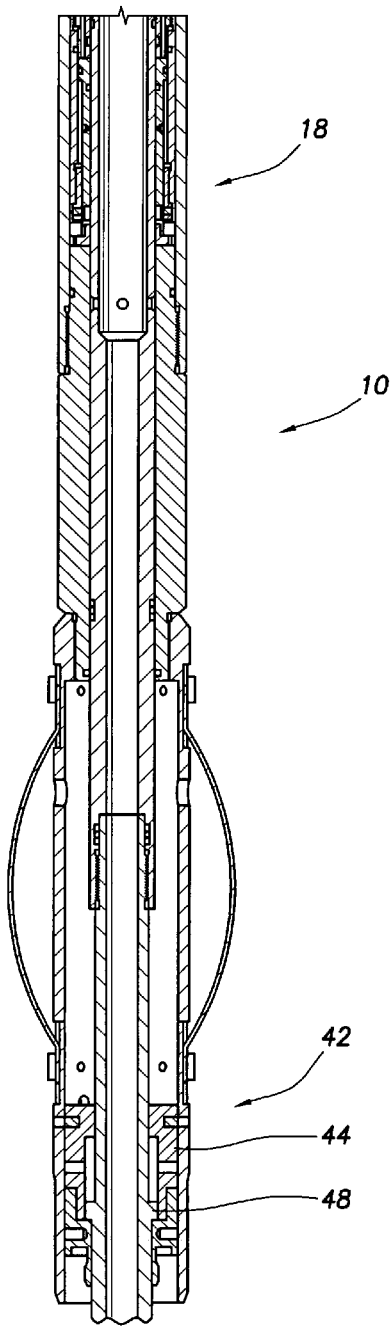
Figure 11:
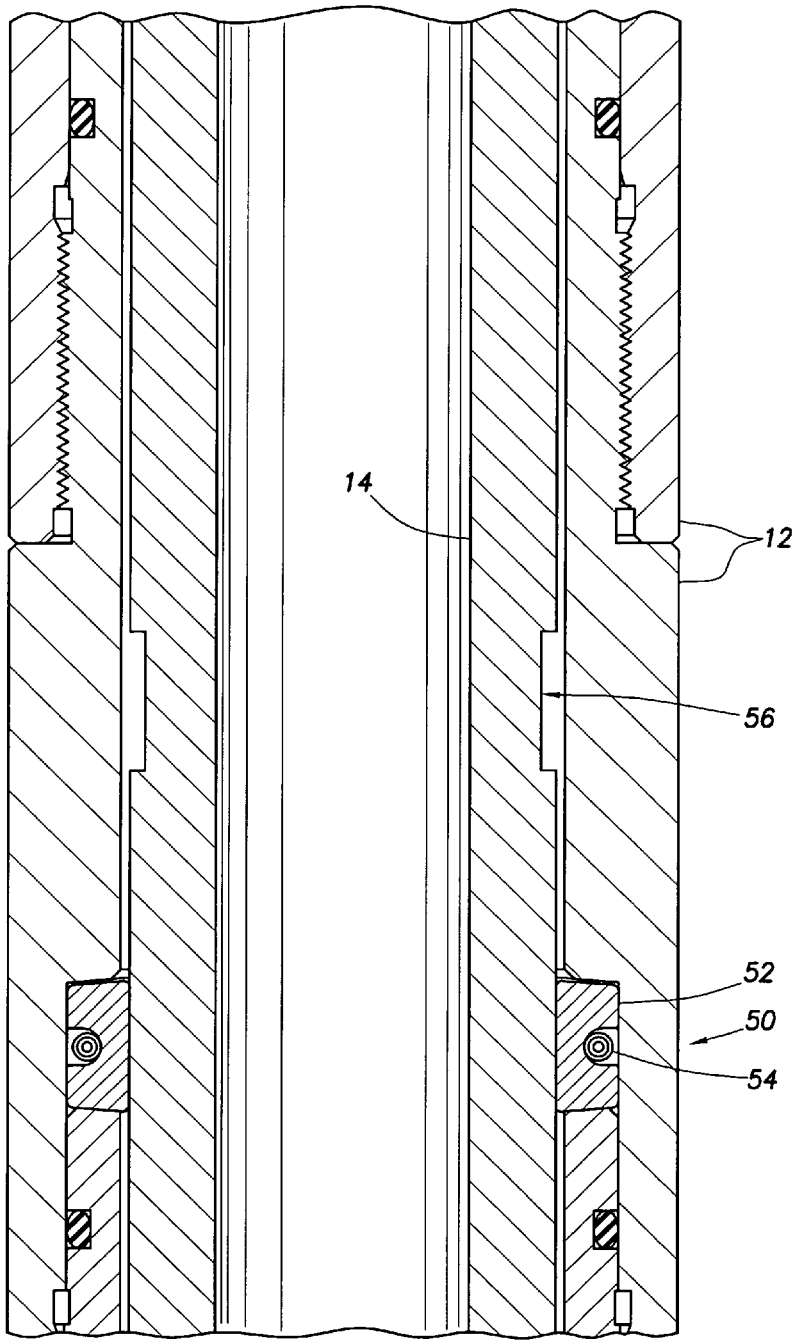
FIG. 11 is an enlarged schematic diagram of the upper section of the hydraulic setting tool in accordance with the present invention illustrating the mechanism that locks the hydraulic setting tool in the stinger-locked position.

Setting tool 10 comprises another locking device 50, which is provided to place the setting tool 10 in a "stinger-locked" position as shown in FIGS. 7–9. In the stinger-locked position, the setting tool 10 is able to open a valve of the packer 68. The locking device 50 comprises a plurality of locking keys 52, as shown in FIG. 5. Preferably, eight locking keys 52 are provided around the circumference of the inner mandrel 14. More preferably, the locking keys 52 are spaced equidistant around the circumference of the inner mandrel 14, i.e., 45° apart from one another. The locking keys 52 are disposed between inner mandrel 14 and the outer sleeve 12, as shown in FIG. 11. The locking keys 52 are generally rectangular-shaped, and generally radius-shaped in cross section. The locking keys 52 are housed within a recess in the inner surface of the outer sleeve 12 and are forced into engagement with the outer surface of the inner mandrel 14 by a retaining spring 54. A recessed groove 56 is formed along the outer surface of the inner mandrel 14 and is designed to accommodate the eight locking keys 52. In particular, the groove 56 is approximately equal to or slightly larger in length and width to the locking keys 52. The retaining spring 54 forces the locking keys 52 into the groove 56 when the groove 56 is directly aligned under the locking keys 52, which occurs in the stinger-locked position. Inner mandrel 14 is placed in the stinger-locked position by the spring 16, as will be described in more detail below.

The operation of the setting tool 10 in accordance with the present invention will now be described. In operation, the setting tool 10 (which is attached at one end to the workstring and has hanging from it at the other end packer 68) is placed into the wellbore, which is typically filled with fluid. A fill-in valve, which is part of the workstring (not shown) is provided to allow the fluid within the well to flow into the inside of the workstring and setting tool 10. The fill-in valve is configured such that once the desired depth is achieved the fill-in valve closes. The fill-in valve employs a sleeve, which is held in place by shear pins, which shear once the desired depth is reached. The shearing of the shear pins causes the sleeve to slide over input ports, which in turn closes the flow of fluid into the workstring and setting tool 10. As those of ordinary skill in the art will appreciate, other mechanisms may be employed to fill the workstring and setting tool 10 while running in the wellbore.

The configuration shown in FIGS. 1–3 is the configuration in which the setting tool 10 is placed into the wellbore. This is known as the run-in position. In this position, spring 16 is partially compressed and therefore is run-in in a partially pre-loaded condition. Also, in this position, the bi-directional locking device 18 is placed in the locked position and thereby bi-directionally locks inner mandrel 14 to the outer sleeve 12. Furthermore, in the run-in position, the locking device 42 is also placed in the locked position, which precludes the inner mandrel 14 from moving upward relative to the outer sleeve 12.

Once the setting tool 10 has reached its desired position within the well, i.e., the position wherein it can set the packer 68, the workstring ceases to be lowered into the well. As previously mentioned, the shear pins 36 and shear pins 46 engage locking devices 18 and 42, respectively, which in turn prevent the inner mandrel 14 from moving axially in either direction relative to the outer sleeve 12. This pre-locked position prevents such movement and therefore premature setting of the packer 68 in the event that any unexpected movement occurs downhole.

In order to set the packer 68, fluid is pumped down into the setting tool 10 through the inside of the inner mandrel 14. The fluid exits ports 32 and in turn enters lower chamber 30. As the pressure builds, it applies an upward force onto the locking ring housing 20. The inner and outer O-rings 22 and 24 prevent the fluid from entering into the upper chamber 28. Once sufficient pressure is reached, the shear pin 36 fails forcing the locking ring housing 20 to push upward, which in turn moves the flange 38 out of engagement with the locking lugs 40. This in turn disengages the bi-directional locking device 18, which but for the engagement of the locking device 42 would otherwise allow the inner mandrel 14 to move axially relative to the outer sleeve 12. In order to disengage the locking device 42, fluid is continued to be pumped down the workstring to the setting tool 10. Additional pressure is applied until the shear pin 46 ultimately fails.

Figure 4:
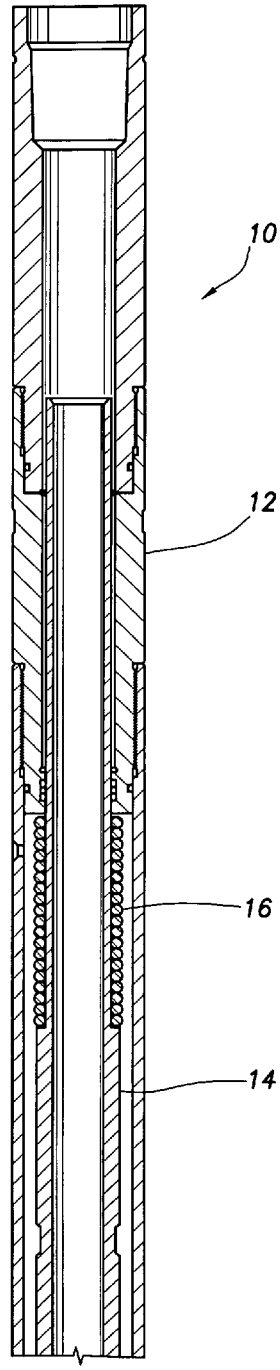
FIGS. 4–6 are schematic diagrams of non-continuous portions of the upper, middle and lower sections of the hydraulic setting tool in accordance with the present invention shown in a "shear-off" position.
Figure 6:
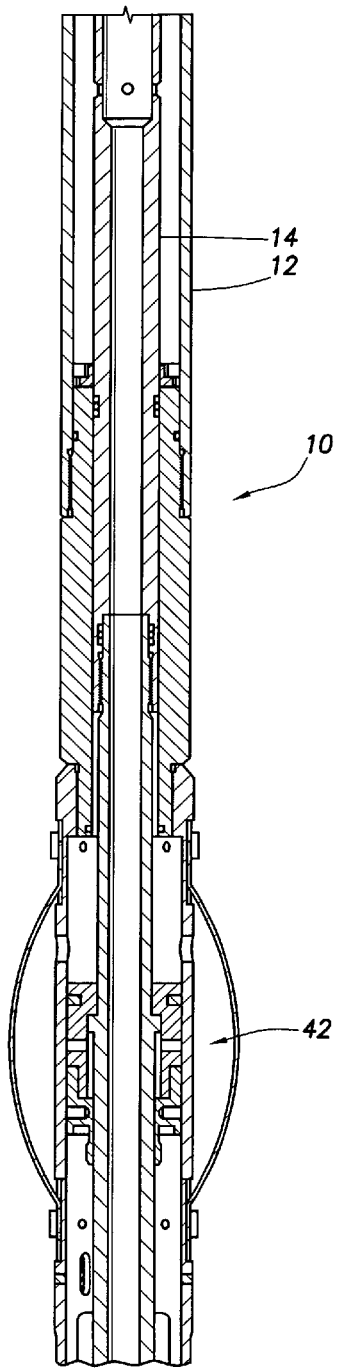
Figure 12:
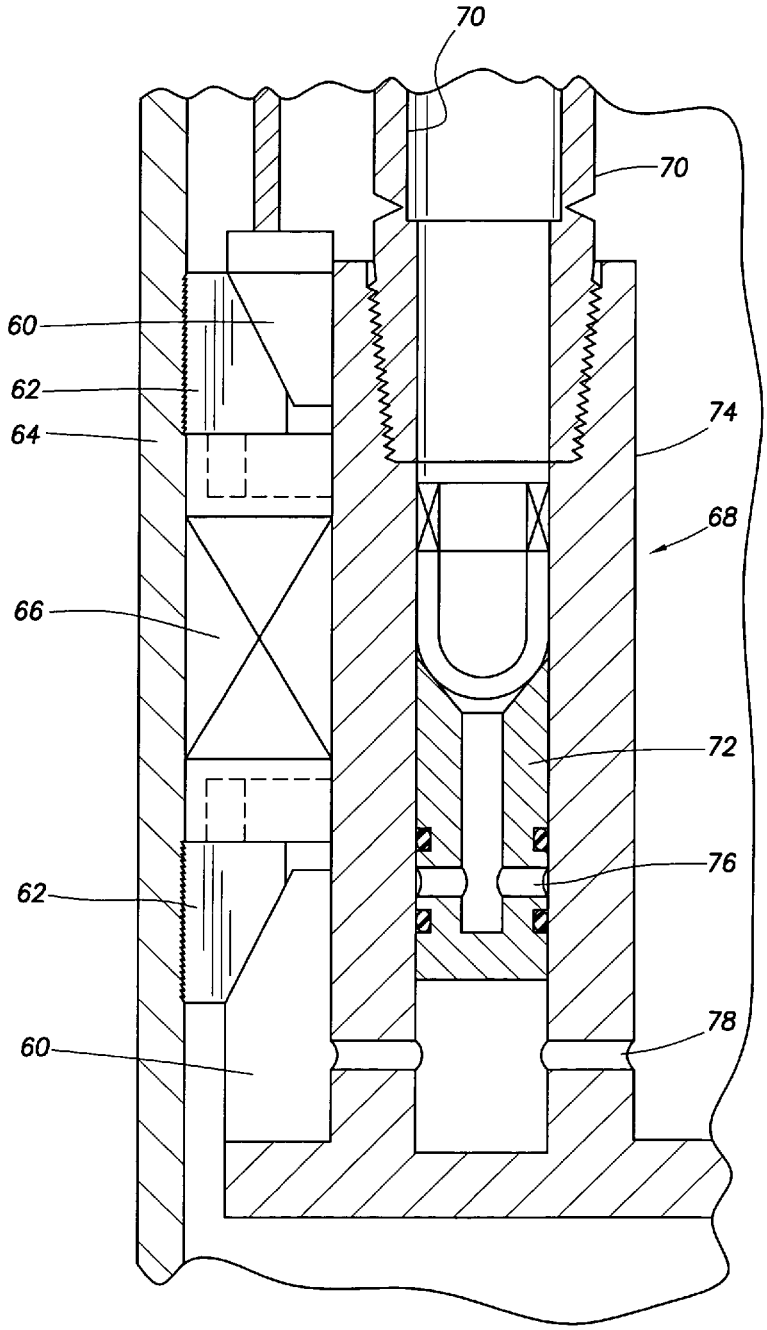
FIG. 12 is a schematic diagram showing one side of a drillable packer, which is attached at an end of the hydraulic setting tool in accordance with the present invention.

As pointed out above, the full pressure required to shear pin 46 is higher than that necessary to shear the shear pins 36. Once the shear pin 46 has failed, the inner mandrel 14 is free to move axially in either direction relative to the outer sleeve 12. The fluid pressure forces the inner mandrel 14 upward. As the inner mandrel 14 is forced upward, it compresses the spring 16 as shown in FIG. 4. It is this upward movement of the setting tool 10 which sets the packer 68. As shown in FIG. 12, as the inner mandrel 14 is pushed upward, wedges 60 press against slips 62 and force them into an interference fit engagement with the inner wall of casing string 64. Flange tips formed on the slip 62 compress against an elastomeric membrane 66 forcing it into engagement with the inner wall of the casing string 64 in turn causing it to form a hermetic seal between the inner wall of the casing string 64 and the packer 68. Fluid is continuously pumped downhole during this step in the process thereby increasing the pressure to the point that tension sleeve 70 connecting the setting tool 10 to the packer 68 shears in tension. The pressure required to shear the tension sleeve 70 from the packer 68 is higher than that required to shear the pins 46. This position, the "shear-off" packer position, is shown in FIGS. 4–6.

Once the packer 68 has been set, the next step is to open the valve within the packer 68 so that the treatment fluids can be pumped down into the workstring into the formation. This is accomplished by bleeding off the pressure of the fluid being pumped down through the workstring into the setting tool 10. By bleeding off the pressure, the spring 16, which in the shear-off packer position is in compression, forces the inner mandrel 14 to move downward, which in turn pushes against a sliding valve 72 formed within the packer 68. This action forces the sliding valve 72 downward, which in turn aligns ports 76 within the sliding valve 72 with a port 78 formed within packer mandrel 74, which in turn, communicates with a subterranean formation.

The setting tool 10 is locked into this position by activation of the locking device 50. It is this position that the locking keys 52 recess into the groove 56. Retaining spring 54 forces the locking keys 52 into engagement with the groove 56, which axially fixes the inner mandrel 14 to the outer sleeve 12. The setting tool 10 is held in this position while the treatment fluids are pumped into the subterranean formation. When the treatment of this region of the subterranean formation is complete, the entire workstring is pulled out of the well. As this occurs, the sliding valve 72 moves into the closed position thereby isolating the inside of the well from the subterranean formation.

Once the workover is complete, the workstring and setting tool 10 are pulled out of the well, the packer 68 is drilled out of the casing string 64 or wellbore, as is the case, and the well is then prepared for being taken back on line.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A setting tool, comprising:

an outer sleeve;

an inner mandrel coaxially disposed within the outer sleeve and adapted to move axially relative to the outer sleeve;

first means for locking the inner mandrel into a first predetermined axial position relative to the outer sleeve;

means for biasing the inner mandrel into a second predetermined axial position relative to the outer sleeve;

second means for locking the inner mandrel into the second predetermined axial position; and wherein the first locking means comprises a locking ring housing disposed between the inner mandrel and the outer sleeve, wherein the locking ring housing is adapted to be axially movable relative to the inner mandrel and outer sleeve.

2. The setting tool of claim 1 further comprising a housing connection attached to the inner mandrel, wherein the first locking means further comprises a piston pin housing disposed between the housing connection and the locking ring housing.

3. The setting tool of claim 2 further comprising:

a first O-ring to seal the locking ring housing to the inner mandrel; and a second O-ring to seal the locking ring housing to the housing connection.

4. The setting tool of claim 3 wherein the first locking means further comprises a first shear pin adapted to fail under a predetermined load, wherein the first shear pin temporarily secures the locking ring housing to the piston pin housing.

5. The setting tool of claim 4 wherein the first locking means further comprises at least one locking lug that is disposed between a flanged end of the locking ring housing, the outer sleeve, and the inner mandrel, wherein the at least one locking lug prevents movement of the inner mandrel relative to the outer sleeve.

6. The setting tool of claim 5 wherein the at least one locking lug comprises four locking lugs spaced equidistant from one another around an outer circumference of the inner mandrel.

7. The setting tool of claim 6 wherein the first locking means further comprises a shear coupling disposed between the inner mandrel and the outer sleeve, wherein the shear coupling has a shoulder against which a flanged-shaped portion of the inner mandrel abuts.

8. The setting tool of claim 7 wherein the first locking means further comprises a second shear pin adapted to fail under a predetermined load, wherein the second shear pin temporarily secures the shear coupling to the outer sleeve to prevent movement of the inner mandrel relative to the outer sleeve.

9. The setting tool of claim 8 wherein the predetermined load necessary to cause the second shear pin that temporarily secures the shear coupling to the outer sleeve to fail is greater than the predetermined load necessary to cause the first shear pin that temporarily secures the locking ring housing to the piston pin housing to fail.

10. The setting tool of claim 1 wherein the first locking means further comprises a shear coupling disposed between the inner mandrel and the outer sleeve, wherein the shear coupling has a shoulder against which a flanged-shaped portion of the inner mandrel abuts.

11. The setting tool of claim 10 wherein the first locking means further comprises a shear pin adapted to fail under a predetermined load, wherein the shear pin temporarily secures the shear coupling to the outer sleeve to prevent the inner mandrel from moving relative to the outer sleeve.

12. The setting tool of claim 1 wherein the biasing means comprises a helical spring, wherein a first end of the helical spring engages a shoulder formed in the inner mandrel and a second end of the helical spring engages a shoulder formed in the outer sleeve.

13. The setting tool of claim 1 wherein the second locking means comprises:

a locking key disposed in a first groove in the outer sleeve; and a spring, wherein the spring forces the locking key into a second groove formed in the inner mandrel when the inner mandrel is in the second predetermined axial position thereby preventing movement of the inner mandrel relative to the outer sleeve.

14. The setting tool of claim 1 wherein the first predetermined axial position is a run-in position.

15. A setting tool, comprising:

an outer sleeve;

an inner mandrel coaxially disposed within the outer sleeve and adapted to move axially relative to the outer sleeve;

a locking ring housing disposed between the inner mandrel and the outer sleeve, wherein the locking ring housing is adapted to move axially relative to the inner mandrel and outer sleeve;

a housing connection disposed within the outer sleeve;

a piston pin housing disposed between the housing connection and the locking ring housing;

a first shear pin adapted to fail under a predetermined load, wherein the first shear pin temporarily secures the locking ring housing to the piston pin housing; and at least one locking lug disposed between a flanged end of the locking ring housing and the inner mandrel, wherein the at least one locking lug prevents movement of the inner mandrel relative to the outer sleeve.

16. The setting tool of claim 15 further comprising:

a first O-ring to seal the locking ring housing to the inner mandrel; and a second O-ring to seal the locking ring housing to the housing connection.

17. The setting tool of claim 15 wherein the at least one locking lug comprises four locking lugs spaced equidistant from one another around an outer circumference of the inner mandrel.

18. The setting tool of claim 15 further comprising a shear coupling disposed between the inner mandrel and the outer sleeve, wherein the shear coupling has a shoulder against which a flanged-shaped portion of the inner mandrel abuts.

19. The setting tool of claim 18 further comprising a second shear pin adapted to fail under a predetermined load, wherein the second shear pin temporarily secures the shear coupling to the outer sleeve to prevent movement of the inner mandrel relative to the outer sleeve.

20. The setting tool of claim 19 wherein the predetermined load necessary to cause the second shear pin that temporarily secures the shear coupling to the outer sleeve to fail is greater than the predetermined load necessary to cause the first shear pin that temporarily secures the locking ring housing to the piston pin housing to fail.

21. The setting tool of claim 15 further comprising a helical spring, wherein a first end of the helical spring engages a shoulder formed in the inner mandrel and a second end of the helical spring engages a shoulder formed in the outer sleeve.

22. The setting tool of claim 15 further comprising:

a locking key disposed in a first groove in the outer sleeve; and a spring, wherein the spring forces the locking key into a second groove formed in the inner mandrel thereby preventing movement of the inner mandrel relative to the outer sleeve.

* * * * *